United States Patent [19]

Nagasawa et al.

[11] Patent Number: 4,832,516

[45] Date of Patent: May 23, 1989

[54] DOT MATRIX PRINT HEAD

[75] Inventors: Hideo Nagasawa, Kanagawa; Kazuyoshi Suzuki, Yokohama; Tadashi Ishizuka, Oyama, all of Japan

[73] Assignee: NCR Corporation, Dayton, Ohio

[21] Appl. No.: 177,791

[22] Filed: Apr. 6, 1988

Related U.S. Application Data

[63] Continuation of Ser. No. 934,973, Nov. 24, 1986, abandoned.

[30] Foreign Application Priority Data

Dec. 5, 1985 [JP] Japan ..... 60-187918

[51] Int. Cl.[4] ..... B41J 3/12

[52] U.S. Cl. ..... 400/124; 101/93.05

[58] Field of Search ..... 335/255; 400/124; 101/93.05

[56] References Cited

U.S. PATENT DOCUMENTS

| | | | |
|---|---|---|---|
| 3,467,232 | 9/1969 | Paige | 400/124 |
| 3,782,520 | 1/1974 | Howard | 400/124 |
| 3,802,543 | 4/1974 | Howard | 400/124 |
| 3,907,092 | 9/1975 | Kwan et al. | 400/124 |
| 4,141,661 | 2/1979 | Geis | 400/124 |
| 4,154,541 | 5/1979 | Tsukada | 400/124 |
| 4,279,521 | 7/1981 | Kightlinger | 400/124 |
| 4,365,902 | 12/1982 | Biedermann et al. | 400/124 |
| 4,447,166 | 5/1984 | Ochiai et al. | 400/124 |

OTHER PUBLICATIONS

*Handbook of chemistry & Physics,* 45th Edition, The Chemical Rubber Company, 1964, p. E-3.

*Primary Examiner*—Paul T. Sewell

*Attorney, Agent, or Firm*—Wilbert Hawk, Jr.; Albert L. Sessler, Jr.; George J. Muckenthaler

[57] ABSTRACT

A wire guide tip in a wire dot printer is made of ceramic and is integrally formed with the front wire guide and inserted during mold processing of the front wire guide.

6 Claims, 4 Drawing Sheets

PRIOR ART

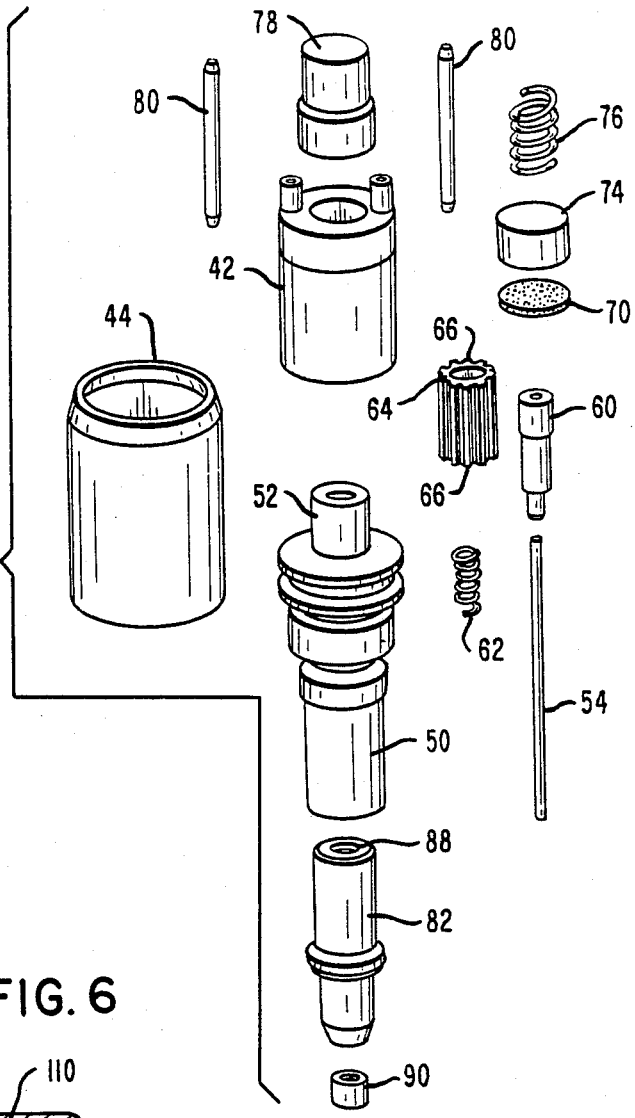
FIG. 4
FIG. 6
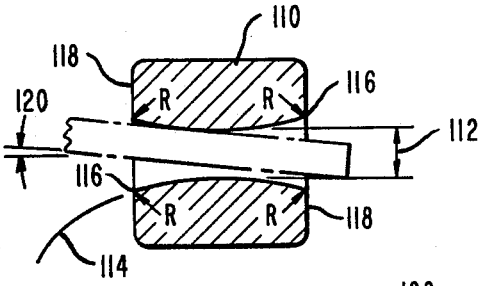
FIG. 5
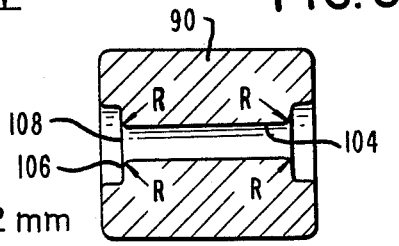
R ≈ 0.02 mm

DOT MATRIX PRINT HEAD

This is a continuation of co-pending application Ser. No. 934,973 filed on Nov. 24, 1986, abandoned.

BACKGROUND OF THE INVENTION

In the field of printing, the most common type of printer has been the printer which impacts against record media that is caused to be moved past a printing line or line of printing. As is well-known, the impact printing operation depends upon the movement of impact members, such as print hammers or wires or the like, which are typically moved by means of an electromechanical system and which system enables precise control of the impact members.

In the field of dot matrix printers, it has been quite common to provide a print head which has included therein a plurality of print wire actuators or solenoids arranged or grouped in a manner to drive the respective print wires a precise distance from a rest or non-printing position to an impact or printing position. The print wires are generally either secured to or engaged by the solenoid plunger or armature which is caused to be moved such precise distance when the solenoid coil is energized and wherein the plunger normally operates against the action of a return spring.

In the wire matrix printer, the print head structure may be a multiple-element type with the wire elements aligned in a vertical line and supported on a print head carriage which is caused to be moved or driven in a horizontal direction for printing in line manner, while the drive elements or transducers may be positioned in a circular configuration with the respective wires leading to the front tip of the print head.

Alternatively, the printer structure may include a plurality of equally-spaced, horizontally-aligned single-element print heads which are caused to be moved in back-and-forth manner to print successive lines of dots in making up the lines of characters. In this latter arrangement, the drive elements or transducers are individually supported along a line of printing. These single wire actuators or solenoids are generally tubular or cylindrically shaped and include a shell which encloses a coil, an armature and a resilient member arranged in manner and form wherein the actuator is operable to cause the print wire to be axially moved a small precise distance in dot matrix printing. The print wire is contained and guided at the front of the solenoids in axial direction during the printing operation.

Representative documentation in the field of dot matrix print head wire guide means includes U.S. Pat. No. 3,467,232, issued to W. G. Paige on Sept. 16, 1969, which discloses an end cap made of Teflon or another low friction material.

U.S. Pat. No. 3,782,520, issued to R. Howard on Jan. 1, 1974, discloses a jewel bearing press fitted into a recess of a guide tube and swaged over the end to retain the jewel.

U.S. Pat. No. 3,907,092, issued to O. Kwan on Sept. 23, 1975, discloses a jewel in the front of the print head with print wire openings in the jewel.

U.S. Pat. No. 4,154,541, issued to T. Tsukada on May 15, 1979, discloses a lip guide formed from a jewel member fixed to the forward end of the print head.

U.S. Pat. No. 4,365,902, issued to H. H. Biederman on Dec. 28, 1982, discloses wire guides made from a ruby rod placed into a recess at the front of the print head and cemented in the recess.

And, U.S. Pat. No. 4,447,166, issued to K. Ochiai on May 8, 1984, discloses an artificial ruby or sapphire or aluminum oxide needle guide received or inserted into the front portion of a guide holder of the print head.

SUMMARY OF THE INVENTION

The present invention relates generally to impact printing devices for dot matrix printing wherein at least one print wire is propelled against a printing medium by an associated plunger type solenoid print wire driver for printing dot matrix characters in accordance with external control signals which cause plunger coil energization, in turn effecting character printing.

More particularly, the present invention relates to an improved print head having a solenoid of the hollow core design which includes a bushing member that provides a seat for the return spring and also a guide for the print wire.

The front of the print head has a print wire guide assembly which includes an elongated member fitted into the core of the solenoid, and a wire guide formed as an integral part of the elongated member and made of ceramic material to provide a precise guide for the print wire.

In accordance with the above discussion, the principal object of the present invention is to provide an improved dot matrix type wire printer.

Another object of the present invention is to provide a wire guide system for simplifying the assembly of a dot matrix print head.

An additional object of the present invention is to provide a wire guide that reduces friction during operation of the print head.

A further object of the present invention is to provide a ceramic guide member that is integrally inserted into a front portion of the print head.

Additional advantages and features of the present invention will become apparent and fully understood from a reading of the following description taken together with the annexed drawing.

BRIEF DESCRIPTION OF THE DRAWING

FIG. 4 is an exploded view showing the parts of the print head;

FIG. 5 is a sectional view of the print wire guide element that is integrally formed in the front portion of the print head; and FIG. 6 is a sectional view of a modified print wire guide element.

DESCRIPTION OF THE PREFERRED EMBODIMENT

Figure 1:
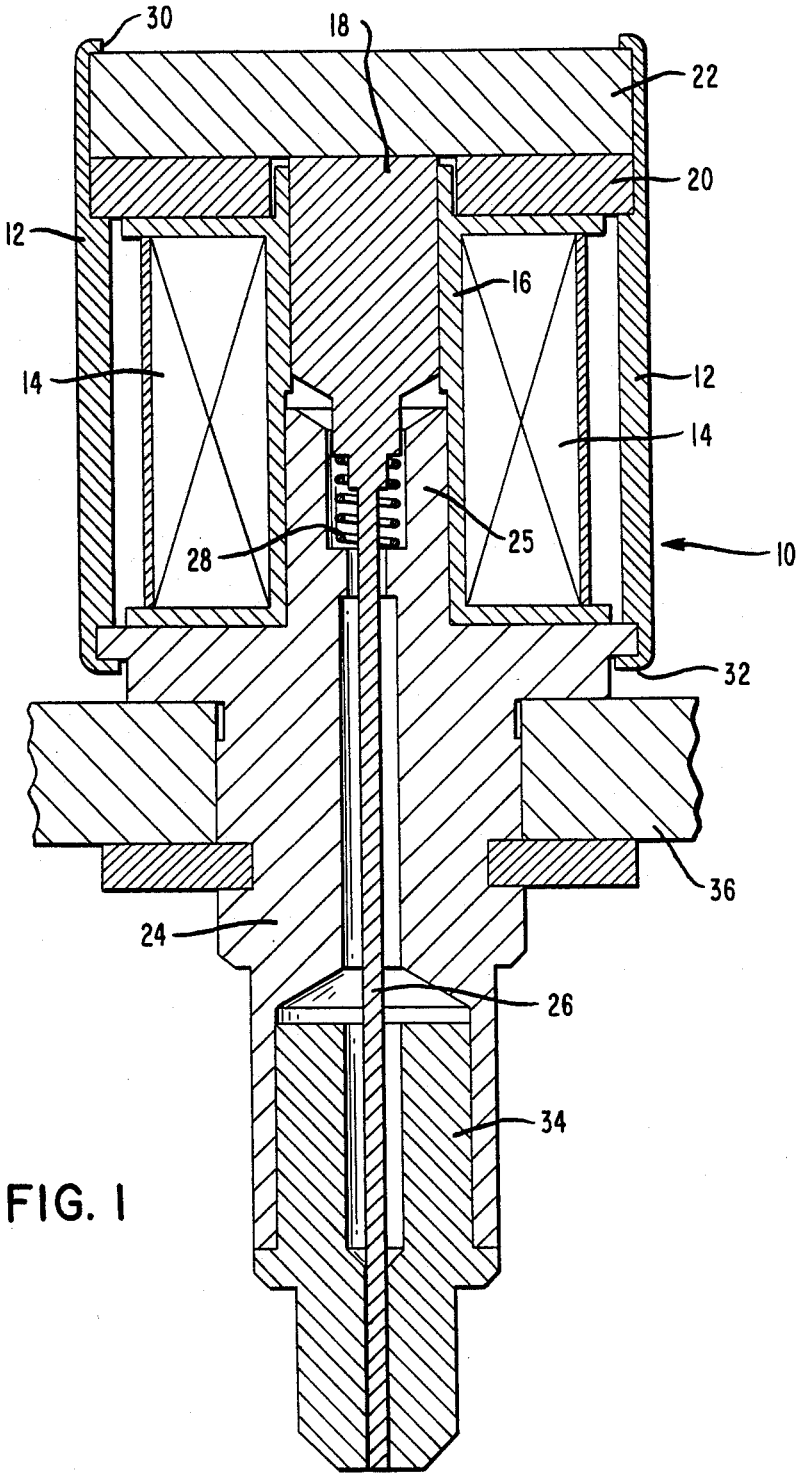
FIG. 1 is a sectional view of a print head of prior art construction.

Prior to describing the structure of the present invention, FIG. 1 shows a cross-sectional view of a conventional dot printer in the form of a solenoid 10 having a shell or case 12 that encloses a coil 14 wound around a bobbin 16. A plunger or armature 18 is substantially enclosed by the bobbin 16, and a ring core 20 is placed adjacent one end of the bobbin. A cap 22 is crimped by an end or edge portion 30 of the case 12 to contain the above parts contiguous with a core 24. A print wire 26 is attached to the armature 18 and a spring 28 is provided adjacent the core 24 and generally within a core pole 25 for returning the print wire 26 to the home position after energization of the coil 14 in printing operation. An opposite end or edge portion 32 of the case 12 is crimped against the core 24 to contain the various parts. A guide member 34 is provided at the front of the core 24 for guiding the print wire 26. A plate structure 36 may be used for supporting the solenoid 10.

Figure 2:
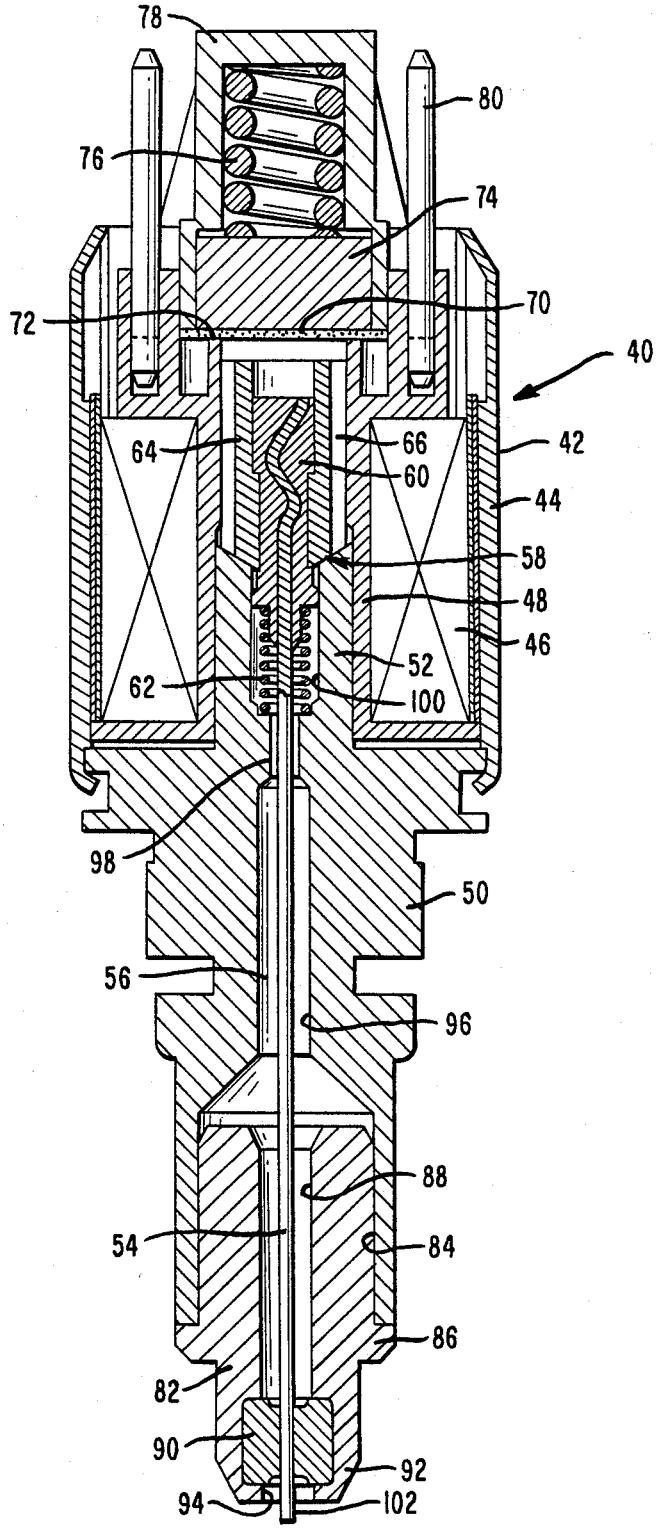
FIG. 2 is a sectional view of a print head incorporating the structure of the present invention.
Figure 3:
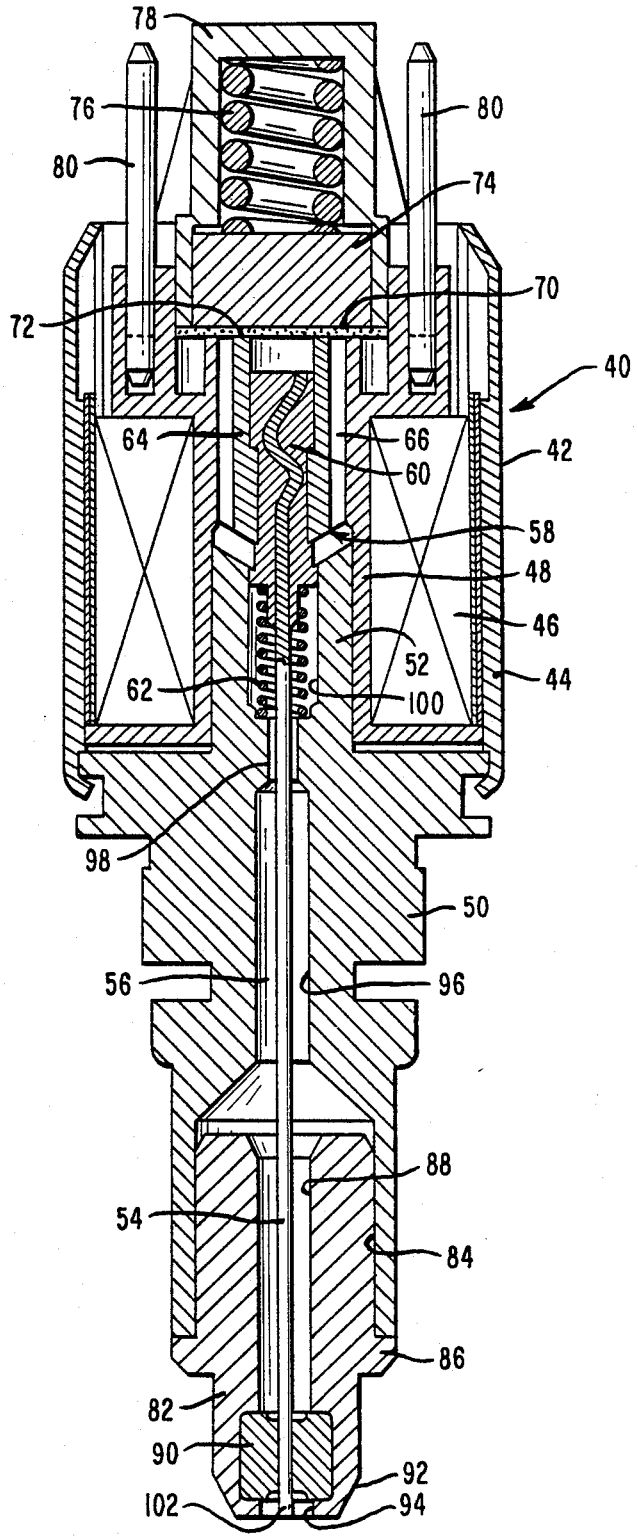
FIG. 3 is a similar view showing certain parts of the print head in another position.

FIG. 2 illustrates a cross-sectional view of a wire dot printer 40 of the present invention with certain of the parts being in an operated or printing position, and FIG. 3 illustrates a similar view of the printer 40 with such parts being in a non-operated or home position. The printer 40 includes a solenoid 42 having a shell or case 44 that encloses a coil 46 wound around a bobbin 48. A core 50 is located adjacent the bobbin 48 and has a core pole 52 extending within the center of the bobbin. A print wire 54 extends through an opening 56 in the core 50, the opening being of different diameters at several places within the core 50 for purposes to be later described. A plunger or armature 58 is located inside the bobbin 48 and assumes the shape of a sleeve encircling a plunger core pole 60 at the rear or actuating portion of the printer 40. One end of the print wire 54 is secured to and within the core pole 60 and extends through a coil spring 62 which has one end thereof engaging a seat of the core pole 60 and the other end engaging a seat of the core 50 in the vicinity of the core pole 52. The sleeve portion 64 of the plunger 58 is coupled with and secured to the core pole 60 by means of adhesive or the like and is formed to provide a gap 66 between the outside diameter of the sleeve 64 and the inside diameter of the bobbin 48.

An elastic or resilient plate 70 abuts an end portion 72 of the bobbin 48 on one side of the plate and abuts an end member 74 which is biased by means of a coil spring 76 and covered by a cap 78. A pair of coil terminals, as at 80, are provided to connect the coil 46 to a voltage source (not shown).

The front or operating portion of the printer 40 includes a wire guide 82 fitting in a recess 84 in the front portion of the core 50. The wire guide 82 has a flange portion 86 abutting the end of the core 50 and has an elongated aperture 88 therein which is larger than the print wire 54. A guide tip 90 is formed integral with the front end portion 92 of the wire guide 82 and provides a precise guide for the print wire 54 at the operating end of the printer 40. An aperture 94 of the same diameter as aperture 88 in wire guide 82, and of aperture 96 in core 50, is provided for the print wire 54. The core 50 also defines an aperture 98 of reduced diameter to provide a seat for one end of spring 62 and defines an aperture 100 for clearance in enabling operation of the spring 62. The guide tip 90 is made of ceramic material to provide a true and precise wire guide for the print wire 54.

FIG. 2 shows the operating end 102 of the print wire 54 extending beyond the front end portion 92 of the wire guide 82 in operated position, whereas FIG. 3 shows the operating end 102 even with such portion 92 in the home position. It is also seen that the coil spring 62 is compressed in FIG. 2 relative to its position in FIG. 3, and that in FIG. 2, the plunger 64 has been moved to close the air gap and to seat on the slanted end portion of the core pole 52.

FIG. 4 is an exploded view which shows the form and arrangement of the various parts of the printer 40.

FIG. 5 shows a cross-sectional view of the print wire guide element 90 which is made of ceramic and is integrally molded in the front portion 92 of the print head 40. The hardness of the guide element 90 is controlled to be within the range of Hv 1,200±50 upon the formation thereof so as to provide a balance among the hardness (Hv), the density (P) and the Young's modulus (E).

A modification of the invention shown in FIG. 6 comprises a guide tip 110 which is made of ceramic and is integrally molded in the front portion 92 of the print head 40. The diameter of the aperture 112 is greater than the diameter of the aperture through the guide tip 90 of FIG. 4. The larger diameter aperture 112 is provided to minimize the abrasion of the ceramic guide tip 110 and the print wire 54 which may be produced by mutual sliding friction due to paper dust choking. The aperture 112 is provided with a camber having a radius of 30 mm, as indicated at 114, and the corners 116 at the face ends 118 of the guide tip 110 are rounded at R=0.1 mm during the polishing operation. The camber provides for a maximum angle 120 of two degrees for inclined or slanted position of the print wire 54 and thereby effects a larger air space between the wire and the guide tip 110.

In addition, the surface roughness of 0.8S of the print wire 54 can be attained by the use of rotary swaging as a process step in the working of the wire in order to reduce the abrasive wear. The rotary swaging of the print wire 54 has an advantageous effect on the metal surface and reduces the surface roughness.

Further, the inner surface 104 of FIG. 5 and the inlet portion of the guide tip 90 are polished for a smoothness of 0.2S to reduce the abrasive wear. Since the corners 106 at the sliding face ends 108 of the guide tip 90 are rounded at R=0.02 mm during the polishing operation, the safety factor of the breaking of the wire can be improved. Such wire 54 breakage may occur when the energizing thrust is suddenly loaded on the wire 54 during the printing operation.

The following characteristics of the ceramic guide element 90, as manufactured by ADAMANT Kogyo Co., Ltd., Japan, are as follows:

| | |
|---|---|
| Hardness (Hv) | Hv 1,700 |
| Zirconium Content or purity | 92.9% |
| Density (P) | 6.05 gr/cm$^3$ |
| Young's Modulus (E) | 1.4–2.0 × 10$^4$ kgf/mm$^2$ |
| Surface roughness | 0.2S (Rmax) |
| Tensile strength | 25–30 kgf/mm$^2$ |
| Flexural strength | 90 kgf/mm$^2$ |
| Melting point | 2,720° C. |
| Coefficient of linear thermal expansion | 8.3 × 10$^{-6}$ cm/cm/°C. |
| Crystal size | 10–20 um |

The following characteristics apply to the print wire 54, as supplied either by Kobe Steel Ltd., Japan, or Organ Needle Co., Ltd., Japan.

| | |
|---|---|
| Surface roughness | $\overline{X}$ = 0.306 u |
| (Rmax) (n = 6) | 0.25–0.35 um |
| Density (P) | 8.15 gr/cm$^3$ |
| Young's Modulus (E) | 2.25 × 10$^4$ kgf/mm$^2$ |
| Hardness (Hv) (n = 16) | Hv 905–1,076 $\overline{X}$ = 989 |

A modification of the ceramic guide element 90 includes the following characteristics:

| | |
|---|---|
| Vickers Hardness (Hv) (500 gr Load) | Hv 1200 |
| Density (P) | 6.05 gr/cm$^3$ |
| Young's Modulus (E) | $2.04 \times 10^4$ kgf/mm$^2$ |
| Surface roughness (Rmax) | 0.2 S (inner surface) |
| Flexural strength | 120 kgf/mm$^2$ |
| Melting point | 2700° C. |
| Coefficient of linear thermal expansion | $8 \times 10^{-6}$ cm/cm/°C. |
| Crystal size | 0.2–0.5 um |

It is noted that Hv is the unit symbol stated in ISO/-DIS 146 "Metallic Materials - Hardness Test" and that Vickers hardness is defined as the quotient obtained by dividing the test load (kgf) by the surface area (mm$^2$) of the indentation that is made on the test surface. The test equipment used for the hardness test is Microvickers Hardness Tester and reference is made to ASTM E384 "Standard Method of Test for Microhardness of Metals". A FIG. of Hv 989 for the print wire 54 is the average value of Vickers hardness in the range of Hv 905-Hv 1,076 (noted above) as measured on sixteen (16) test pieces, and a preferred Vickers hardness is Hv 950±50.

The scale or measuring method of the surface roughness is the maximum height (Rmax) of profile or irregularities on the surface. The measured value of maximum height Rmax of profile (irregularities) is indicated in um units. The values of surface roughness are designated by unit symbol "S". In the above notation, the smoothness or surface roughness "0.2S" means that the irregularities are between 0 um and 0.2 um or that 0 um Rmax is less than or equal to 0.2S, is less than or equal to 0.2 um Rmax. Reference is made to ISO R468 "Surface Roughness" for additional information.

In the operation of the printer 40 of the present invention, the coil 46 of the solenoid 42 is energized through terminals 80 and the plunger or armature 58 moves inside the core pole 52, and within the aperture 100 in opposition to the resilience of the spring 62. The movement of the plunger 58 moves the print wire 54 through the guide tip 90 in a precise path for printing of a dot in printing operation.

When the solenoid 42 is de-energized, the plunger 58 is returned to the non-printing position, as shown in FIG. 3, by means of the spring 62. At nearly the end of this return motion of the armature or plunger 58, the end surface thereof is pressed and urged against the core by the spring 76 and impacts against the resilient plate 70 which abuts the end surface of the bobbin 48. It is thus seen that the resilience of the plate 70 and of the coil spring 76 as well as the weight of the end member 74 combine to absorb and to alleviate the return impact, thereby preventing rebounding of the print wire 54.

It is thus seen that herein shown and described is a wire printer for printing characters in dot matrix manner wherein the print wire is guided at the operating or front end of the printer by means of a ceramic guide tip to provide a true guide for the print wire. The guide tip of the present invention enables the accomplishment of the objects and advantages mentioned above, and while a preferred embodiment of the invention has been disclosed herein, variations thereof may occur to those skilled in the art. It is contemplated that all such variations not departing from the spirit and scope of the invention hereof are to be construed in accordance with the following claims.

We claim:

1. A print wire guide in a wire dot printer having apertured core means and means for moving the print wire in an axial direction through said core means and through a guide portion having an aperture therethrough at the operating end of the printer, said print wire guide being positioned at one end of said core means and comprising a ceramic guide element having an aperture therethrough and integrally molded in said guide portion and captured within and contained by said guide portion, said ceramic guide element including an outer face having an enlarged counterbored aperture therein smaller than the aperture in said guide portion, said counterbored aperture being of cylindrical configuration and the aperture in said ceramic guide element through which said print wire passes defining a print wire sliding face spaced from said outer face, said counterbored aperture avoiding engagement between said print wire and the outer face of said ceramic guide element.

2. The print wire guide of claim 1 wherein the ceramic guide element is made of ceramic material having a Vickers Hardness in the range of Hv 1200 to Hv 1700, a Zirconium content of about 93%, a density of about 6.0 grams/cm$^3$, a surface roughness of about 0.2S, and a melting point of about 2700° C.

3. A wire dot printer comprising a print wire, a housing, an energizing means contained within the housing, a core adjacent and associated with the energizing means and providing a passageway for the print wire, actuating means operably associated with the energizing means for moving the print wire along said passageway in printing operation, and guide means positioned at one end of the core and including a ceramic guide member having an aperture therethrough and molded integrally in one end of the core and captured therein and including an outer face having an enlarged counterbored aperture therein, said counterbored aperture being of cylindrical configuration and the aperture in said ceramic guide member through which said print wire passes defining a print wire sliding face spaced from said outer face, said counterbored aperture avoiding engagement between said print wire and the outer face of said ceramic guide member.

4. In a wire dot printer having a housing, an actuating coil within the housing, a core member associated with the actuating coil, a plunger moveable by the actuating coil and having a print wire secured thereto, the improvement comprising means at one end of the core member for guiding the operating end of the print wire and including a ceramic guide member having an aperture therethrough and integrally molded in said guiding means and captured within the guiding means for providing a guide for the print wire, said ceramic guide member including an outer face having an enlarged counterbored aperture therein, said counterbored aperture being of cylindrical configuration and the aperture in said ceramic guide member through which said print wire passes defining a print wire sliding face spaced from said outer face, said counterbored aperture avoiding engagement between said print wire and the outer face of said ceramic guide member.

5. In the wire dot printer of claim 4 wherein the ceramic guide member is a ceramic element secured within the guiding means and is made of material having a Vickers Hardness in the range of Hv 1200 to Hv 1700, a Zirconium content of about 93%, a density of about 6.0 grams/cm$^3$, a Youngs Modulus of about $2\times10^4$ kgf/mm$^2$, a surface roughness of about 0.2S, a tensile strength of about 25 to 30 kgf/mm$^2$, a flexural strength in the range of 90 to 120 kgf/mm$^2$, and a melting point of about 2700° C. and the print wire is made of material having a Vickers Hardness in the range of Hv 905 to Hv 1075.

6. A print wire guide for use in a wire dot printer having core means and means for moving the print wire in an axial direction through said core means and through a guide portion in the printer, said print wire guide being positioned at one end of said core means and comprising a ceramic guide element integrally molded in and contained by said ceramic guide portion and having an aperture through said ceramic guide element, said ceramic guide element including an outer face at each end thereof and having an enlarged counterbored aperture at each end of the ceramic guide element, each of said counterbored apertures being of cylindrical configuration and said aperture in said ceramic guide element through which said print wire passes defining a print wire sliding face spaced from the outer face at each end of the ceramic guide element, and each of said counterbored apertures avoiding engagement between said print wire and the corresponding outer face of said ceramic guide element.

* * * * *